US006376103B1

(12) United States Patent
Sampath et al.

(10) Patent No.: US 6,376,103 B1
(45) **Date of Patent: *Apr. 23, 2002**

(54) ADVANCED MO-BASED COMPOSITE POWDERS FOR THERMAL SPRAY APPLICATIONS

(75) Inventors: Sanjay Sampath, Setauket, NY (US); Jack E. Vanderpool, Laceyville, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/865,952

(22) Filed: May 30, 1997

Related U.S. Application Data

(63) Continuation of application No. 08/538,559, filed on Oct. 3, 1995, now Pat. No. 5,641,580.

(51) Int. Cl.[7] ..... B32B 15/00; C22C 27/04

(52) U.S. Cl. ..... 428/663; 75/240; 75/255; 148/407

(58) Field of Search ..... 75/240, 255; 420/429; 148/407, 423; 428/663

(56) References Cited

U.S. PATENT DOCUMENTS

| | | | | |
|---|---|---|---|---|
| 2,850,385 A | | 9/1958 | Nisbet | 420/429 |
| 3,313,633 A | | 4/1967 | Longo | 106/1.05 |
| 3,837,817 A | | 9/1974 | Nakamura | 428/564 |
| 3,890,137 A | | 6/1975 | Beyer et al. | 75/255 |
| 3,982,970 A | | 9/1976 | Webster et al. | 148/207 |
| 4,216,034 A | * | 8/1980 | Miyake et al. | 75/240 |
| 4,597,939 A | | 7/1986 | Neuhauser et al. | 420/429 |
| 4,716,019 A | | 12/1987 | Houck et al. | 419/17 |
| 4,756,841 A | | 7/1988 | Buran et al. | 75/255 |
| 5,063,021 A | | 11/1991 | Anand et al. | 419/12 |
| 5,292,382 A | | 3/1994 | Longo | 148/320 |
| 5,641,580 A | * | 6/1997 | Sampath et al. | 75/255 |

FOREIGN PATENT DOCUMENTS

| | | | |
|---|---|---|---|
| DE | 3802920 | 5/1989 | C23C/4/04 |
| EP | 0 701 995 A1 | 3/1996 | C23C/4/06 |
| GB | 1099957 | 1/1963 | C23C/7/00 |

OTHER PUBLICATIONS

U. Buran et al., 1st Plasma–Technik–Symposium, vol. 2, pp. 25–36 (1998), Eds. H.Eschnauer et al.

Sampath et al., Proc. 5th National Thermal Spray Conf., pp. 397–403 (1993).

Sampath et al., J. Thermal Spray Technology, vol. 3 (3) pp. 282–288 (1994).

* cited by examiner

*Primary Examiner*—George Wyszomierski
(74) *Attorney, Agent, or Firm*—Robert F. Clark

(57) ABSTRACT

A molybdenum-based composite powder for thermal spray applications. The composite powder includes a molybdenum-chromium, molybdenum-tungsten, or molybdenum-tungsten-chromium alloy dispersion strengthened with molybdenum carbide ($Mo_2C$). The molybdenum-based composite powder may be combined with a nickel-based or cobalt-based alloy to form a two-phase powder blend. The coatings from such powders are made up of molybdenum-based alloy lamellae and, in the two-phase embodiments, nickel-based or cobalt-based alloy lamellae. The coatings exhibit improved corrosion resistance and strength while retaining good sprayability.

15 Claims, No Drawings

ADVANCED MO-BASED COMPOSITE POWDERS FOR THERMAL SPRAY APPLICATIONS

This application is a continuation of application Ser. No. 08/538,559, filed on Oct. 3, 1995, now U.S. Pat. No. 5,641,580.

CROSS-REFERENCE TO RELATED APPLICATIONS

This application is related to commonly assigned, copending U.S. patent application Ser. No. 08/390,732 filed Feb. 17, 1995. Application Ser. No. 08/390,732 is incorporated herein by reference.

BACKGROUND OF THE INVENTION

The present invention relates to a thermal spray powder. In particular, the invention relates to molybdenum-based thermal spray powders useful for producing wear resistant coatings on the sliding contact friction surfaces of machine parts such as piston rings, cylinder liners, paper mill rolls, and gear boxes.

Thermally sprayed molybdenum coatings, due to their unique tribological properties, are useful in the automotive, aerospace, pulp and paper, and plastics processing industries. Molybdenum coatings provide a low friction surface and resistance to scuffing under sliding contact conditions.

Coatings which are flame sprayed from molybdenum wire sources are widely used in the automotive industry as, e.g., running surfaces on piston rings in internal combustion engines. The high hardness of these coatings is attributable to the formation during spraying of $MoO_2$ which acts as a dispersion strengthener. However, the process of flame spraying coatings from molybdenum wire is not sufficiently versatile for the more complex applications being developed for molybdenum coatings. Some of these applications require higher combustion pressures and temperatures, turbocharging, and increased component durability. The molybdenum wire produced coatings do not meet these requirements. Further, there is an increasing need for the tailoring of coating properties based on periodically changing design requirements. Powder based coating technologies, e.g., plasma powder spray offer flexibility in tailoring material/coating properties through compensational control, which is not readily achievable using wire feedstock.

Coatings which are plasma sprayed from molybdenum powder are more versatile than coatings from wire, but are relatively soft, and do not exhibit adequate breakout and wear resistance for the automotive and other applications described above. The molybdenum tends to oxidize during spraying, leading to weak interfaces among the lamellae of the coating and to delamination wear. Also, the aqueous corrosion characteristics of molybdenum coatings are poor.

The molybdenum powder may be blended with a nickel-based self-fluxing alloy powder, for example, powder including nickel, chromium, iron, boron, and silicon, to form a Mo/NiCrFeBSi dual phase powder (also referred to in the art as a pseudo alloy). The improved wear characteristics of a coating flame sprayed from the blend result in a wear resistant coating with desirable low friction properties and scuff resistance.

When this pseudo-alloy powder blend is plasma sprayed, however, the molybdenum particles and the NiCrFeBSi particles tend to form discrete islands in the coating.

Although the overall hardness is greater, in microscopic scale the molybdenum islands are still soft and are prone to breakout and failure. Once the wear process is initiated, the coating exhibits rapid degradation with increased friction coefficient, particle pull out, and delamination.

Another improvement in plasma sprayed molybdenum coatings is described in the publication by S. Sampath et al., "Microstructure and Properties of Plasma-Sprayed Mo—$Mo_2C$ Composites" (*J. Thermal Spray Technology* 3 (3), September 1994, pp. 282–288), the disclosure of which is incorporated herein by reference. A dispersion strengthened coating is plasma sprayed from a Mo—$Mo_2C$ composite powder. The $Mo_2C$ particles dispersed in the molybdenum increase the hardness of the coating. Also, the carbon acts as a sacrificial oxygen getter, reducing the formation of oxide scales between molybdenum lamellae of the coating during spraying and decreasing delamination of the coating. However, the hardness, wear resistance, and aqueous corrosion resistance of the coating is not sufficient for some applications.

Further improvement in plasma sprayed molybdenum coatings is described in above-referenced application Ser. No. 08/390,732. The dual phase powder blend disclosed in application Ser. No. 08/390,732 adds NiCrFeBSi powder to the above-described Mo—$Mo_2C$ composite powder. The coating made from this powder blend exhibits discrete islands similar to those described above for the Mo—NiCrFeBSi coating. The NiCrFeBSi islands have similar advantageous properties to those described above; however, the $Mo_2C$ particles dispersed in the molybdenum increase the hardness of the molybdenum islands, slowing degradation of the coating. Also, the carbon acts as a sacrificial oxygen getter, reducing the formation of oxide scales on the molybdenum islands of the coating during spraying and decreasing delamination of the coating, as described above. However, the aqueous corrosion resistance and/or hardness of the coating are still not sufficient for some applications.

The present invention is directed to even further improving the properties of molybdenum coatings, whether they are plasma sprayed or flame sprayed.

SUMMARY OF THE INVENTION

Accordingly, it is an object of the present invention to overcome the disadvantages of the prior art molybdenum-based thermal spray powders and coatings.

It is another object of the invention to provide molybdenum-based thermal spray powders, as well as powder blends including such powders, for spraying of improved coatings with high aqueous corrosion resistance, high cohesive strength, and uniform wear characteristics without significant loss of sprayability of the powders or of low friction characteristics of the coatings made therefrom.

It is a further object of the invention to provide high hardness, low- and stable-friction coatings exhibiting high aqueous corrosion resistance, high cohesive strength, and uniform wear characteristics.

Accordingly, in one embodiment the invention is a molybdenum-based composite powder for thermal spray applications, the composite powder including an alloy selected from molybdenum-chromium, molybdenum-tungsten, and molybdenum-tungsten-chromium alloys dispersion strengthened with molybdenum carbide precipitates. In a narrower embodiment, the molybdenum-based composite powder includes about 10–30 weight percent of chromium and/or tungsten, about 1–3 weight percent carbon, remainder molybdenum.

In another embodiment, the invention is a blended powder for thermal spray applications, the blended powder including a mixture of (a) a molybdenum-based alloy selected from molybdenum-chromium, molybdenum-tungsten, and molybdenum-tungsten-chromium alloys dispersion strengthened with molybdenum carbide precipitates, and (b) a nickel-based or cobalt-based alloy. In a narrower embodiment, the blended powder consists essentially of about 10–50 weight percent of the nickel-based or cobalt-based alloy, the remainder being the dispersion strengthened molybdenum-based alloy. In still narrower embodiments, the nickel-based or cobalt-based alloy may be a self-fluxing nickel-based alloy comprising nickel, chromium, iron, boron, and silicon, or a Hastelloy® (nickel-based) alloy, or a Tribaloy® (cobalt-based) alloy. (Hastelloy and Tribaloy are registered trademarks of Haynes International and Stoody Deloro Stellite, respectively.)

In a further embodiment, the invention is a thermal spray coating having lamellae of a molybdenum-based alloy selected from molybdenum-chromium, molybdenum-tungsten, and molybdenum-tungsten-chromium alloys dispersion strengthened with molybdenum carbide precipitates. In a narrower embodiment, the thermal spray coating further includes lamellae of a nickel-based or cobalt-based alloy. In still narrower embodiments, the nickel- or cobalt-based alloy may be a self-fluxing nickel-based alloy comprising nickel, chromium, iron, boron, and silicon, or a Hastelloy alloy, or a Tribaloy alloy.

DETAILED DESCRIPTION OF THE PREFERRED EMBODIMENTS

In one exemplary embodiment of the composite powder in accordance with the invention, the properties of a molybdenum-based coating are improved by the addition to the molybdenum of chromium and a small amount of carbon. The chromium forms with the molybdenum a solid solution molybdenum-based alloy, while the carbon reacts with the molybdenum to form molybdenum carbide ($Mo_2C$) precipitates dispersed throughout the molybdenum-chromium alloy to dispersion strengthen the alloy. As used herein, the term "molybdenum-based" is intended to mean an alloy or composite including at least 50 weight percent total molybdenum (reacted and elemental). The amount of carbon is selected based on the amount of $Mo_2C$ desired in the composite powder, which typically is about 20–60 volume percent of the composite powder. Preferably, the dispersion strengthened alloy includes about 10–30 weight percent chromium, about 1–3 weight percent carbon, remainder molybdenum.

The chromium component in the alloy is included to provide improved corrosion resistance over a Mo—$Mo_2C$ powder, while the presence of the carbide in the composite powder provides some dispersion strengthening. The chromium also provides some additional strengthening to the coating. Oxidation of the carbide during thermal spraying provides an additional benefit in that, during the spraying process, the carbon acts as a sacrificial getter for oxygen, reducing the oxidation of molybdenum. With such gettering, oxide free lamellar surfaces can be produced resulting in improved bonding of the molybdenum-chromium alloy lamellae to one another. Thus, delamination during sliding contact is reduced, resulting in a stable coefficient of friction and improved wear resistance.

In another, similar, molybdenum-based composite powder, the chromium is replaced by tungsten. The tungsten and a small amount of carbon are added to the molybdenum to form a solid solution alloy dispersion strengthened with $Mo_2C$. Again, the amount of carbon is selected based on the amount of $Mo_2C$ desired, typically about 20–60 volume percent, in the composite powder. Preferably, the dispersion strengthened alloy includes about 10–30 weight percent tungsten, about 1–3 weight percent carbon, remainder molybdenum.

The alloy of molybdenum and tungsten provides solid solution strengthening to the composite coating, and can provide improved high temperature properties, while the dispersed carbide provides the dispersion strengthening and lamellar bonding benefits described above. The coating exhibits a stable coefficient of friction, improved wear resistance, and high temperature strength.

Alternatively, both chromium and tungsten powders may be added with the carbon powder to the molybdenum powder to form the molybdenum-based alloy. Again, the amount of carbon is selected based on the amount of $Mo_2C$ desired in the composite powder. Preferably, the dispersion strengthened alloy coating includes about 10–30 weight percent of a combination of chromium and tungsten, about 1–3 weight percent carbon, remainder molybdenum.

The chromium component in the alloy provides improved corrosion resistance and hardness, the tungsten component provides added hardness and strength, and the carbide contributes some strengthening and the above-described improved bonding of the molybdenum-chromium-tungsten alloy lamellae to one another. The optimum ratios of chromium to tungsten and of chromium or tungsten to molybdenum in the blend to provide the desired strengthening and corrosion resistance for a particular application may be determined empirically.

The molybdenum-based composite powders may be produced, e.g., by a method similar to that described in U.S. Pat. No. 4,716,019 for producing a molybdenum powder dispersion strengthened with molybdenum carbide (Mo—$Mo_2C$ powder). U.S. Pat. No. 4,716,019 is incorporated herein by reference. The process involves forming a uniform mixture of fine powders of molybdenum and chromium and/or tungsten with a carbon powder having a particle size no greater than that of the metal powders. The amount of the carbon powder is selected based on the amount of molybdenum carbide desired in the composite powder. Alternatively, a molybdenum-chromium or molybdenum-tungsten, or molybdenum-chromium-tungsten alloy may be mixed with the carbon powder. Again, the amount of the carbon powder is proportional to the amount of molybdenum carbide desired in the composite powder.

A slurry is formed from one of these powder mixtures, an organic binder, and water, with the amount of the binder typically being no greater than about 2 weight percent of the powder mixture. The powders are then agglomerated from the slurry, e.g., by spray-drying. Preferably, the agglomerated powders are classified to select the major portion of the agglomerates having a size greater than about 170 mesh and less than about 325 mesh. The selected agglomerates are reacted at a temperature no greater than about 1400° C. in a non-carbonaceous vessel in a reducing atmosphere for a time sufficient to form the agglomerated composite powder. The $(Mo,Cr)Mo_2C$, $(Mo,W)Mo_2C$, or $(Mo,Cr,W)Mo_2C$ powder thus produced retains the desired sprayability and may be used in plasma or flame spraying processes to produce coatings exhibiting high cohesive strength, high aqueous corrosion resistance, stable coefficient of friction, and uniform wear characteristics.

An even further improved coating may be produced from a dual phase powder blend of one of the above-described molybdenum-based composite powders with a nickel-based or cobalt-based alloy. As used herein, the term "nickel-based" or "cobalt-based" is intended to mean alloys or powder mixtures in which nickel or cobalt, respectively, is the major component. A typical example of such a dual phase powder blend is a mixture of about 50–90 weight percent of the above-described dispersion strengthened molybdenum-tungsten, molybdenum-chromium, or molybdenum-chromium-tungsten alloy with about 10–50 weight percent of a self-fluxing nickel-boron-silicon alloy. The nickel-boron-silicon may include such other components as chromium, iron, and/or carbon. Typical of such alloys are the self-fluxing NiCrFeBSi alloy powders described above. A typical composition for such a self-fluxing alloy is, in percent by weight, 0 to about 20% chromium, 0 to about 4% iron, about 2–5% boron, about 2–5% silicon, 0 to about 2% carbon, remainder nickel. One example of a preferred composition for such a self-fluxing alloy is, in percent by weight, 13.6% chromium, 4.4% iron, 3.3% boron, 4.4% silicon, 0.8% carbon, remainder nickel. The coating exhibits improved sprayability, cohesive strength, hardness and wear resistance over the molybdenum-based composite powder alone and results in a coating showing uniform wear, a low coefficient of friction, and good cohesive strength.

Alternatively, a similar dual phase powder may be made by mixing the above-described dispersion strengthened molybdenum-chromium, molybdenum-tungsten, or molybdenum-chromium-tungsten alloy with a commercially available high temperature, moderate hardness, corrosion resistant nickel-based alloy such as a Hastelloy C or Hastelloy D alloy, or of a commercially available high temperature, high hardness, corrosion resistant cobalt-based alloy such as a Tribaloy alloy. The preferred proportions for such a blend are about 50–90 weight percent of the molybdenum-based alloy and about 10–50 weight percent of nickel- or cobalt-based alloy. The Hastelloy alloy component provides further improvement in the corrosion resistance of the sprayed coating, while the Tribaloy alloy component provides a combination of further improved wear and corrosion resistance. The dual phase powder blend may be tailored to provide a coating of selected hardness, wear resistance, corrosion resistance, coefficient of friction, etc. by selection of the dispersion strengthened molybdenum-based alloy component, the nickel- or cobalt-based alloy component, and their ratio by empirical means.

The above-described blended powders combining the dispersion strengthened molybdenum-based alloy with a nickel- or cobalt-based alloy may be produced by making the dispersion strengthened molybdenum-based alloy powder as described above then blending this powder with a nickel- or cobalt-based alloy powder, in accordance with commercially accepted metal powder blending technology. Typically, the nickel- or cobalt-based alloy powders are produced from the alloys by gas atomization. Alternatively, a commercially available nickel- or cobalt-based alloy powder may be used in the blend.

To form the above-described coatings, the composite or blended powders are thermally sprayed, e.g., by known plasma spraying or flame spraying techniques, onto the bearing or friction surfaces of a metal machine part subject to sliding friction, forming a wear resistant, low-friction surface.

The following Example is presented to enable those skilled in the art to more clearly understand and practice the present invention. This Example should not be considered as a limitation upon the scope of. the present invention, but merely as being illustrative and representative thereof.

EXAMPLE

Three experimental and two control thermal spray powder blends were prepared from a molybdenum-based powder, listed as component 1, and a nickel- or cobalt-based alloy powder, listed as component 2. The two control samples included a NiCrFeBSi powder, as shown below, available from Culox Technologies (Naugatuck, Conn.) or Sulzer Plasma-Technik (Troy, Mich.). Sample 3 included a similar NiCrFeBSi powder, as also shown below, available from the same source. Samples 4 and 5 included a Tribaloy cobalt alloy powder and a Hastelloy nickel alloy powder, respectively, both available from Thermadyne Stellite (Kokomo, Ind.). One control sample further contained a chromium carbide/nichrome alloy blend powder available as SX-195 from Osram Sylvania Incorporated (Towanda, Pa.), listed as component 3. All percents given are weight percents unless otherwise indicated.

The $Mo/Mo_2C$ powder was produced in accordance with the process described in detail in U.S. Pat. No. 4,716,019, and is available as SX-276 from Osram Sylvania Incorporated (Towanda, Pa.). The $(Mo,Cr)/Mo_2C$ powder was produced in a similar manner, blending molybdenum, chromium, and carbon powders and processing the blended powders in accordance with the process described in U.S. Pat. No. 4,716,019.

The subcomponents of components 1, 2, and 3 are shown in Table I and are given in weight percent (w/o) or weight ratio unless otherwise indicated. The proportions of components 1, 2, and 3 in the blends, given in weight percent, are shown in Table II. Also shown in Table II are other characteristics of the powder blends: the sample size, grain size fraction (listed by mesh sizes), the Hall flow (in seconds/50 g, and the bulk density.

The powders were plasma sprayed onto degreased and grit blasted mild steel substrates using a Metco plasma spray system to depths of 15–20 mils, using the parameters:

| | |
|---|---|
| Thermal spray gun model: | Metco 9MB |
| Nozzle: | #732 |
| Current: | 500 A |
| Voltage: | 68 V |
| Argon flow: | 80* |
| Hydrogen flow: | 15* |
| Carrier argon flow: | 37* |
| Powder port: | #2 |
| Feed rate: | 30 g/min |
| Spray distance: | 10 cm |

*Metco console units

All of the powders exhibited good wetting in the formation of the coatings, and good coating integrity.

TABLE I

| Sample | Component 1 | Component 2 | Component 3 |
|---|---|---|---|
| 1 (Control) | Mo | NiCrFeBSiC: | |
| | | Cr: 13.6% | |
| | | Fe: 4.4% | |
| | | B: 3.3% | |
| | | Si: 4.4% | |
| | | C: 0.8% | |
| | | Ni: rem. | |

TABLE I-continued

| Sample | Component 1 | Component 2 | Component 3 |
|---|---|---|---|
| 2 (Control) | Mo/$Mo_2C$ | NiCrFeBSiC: | $Cr_3C_2$/(Ni, Cr) |
| | $Mo_2Cr$: 35 v/o*<br>Mo: rem. | Cr: 13.6%<br>Fe: 4.4%<br>B: 3.3%<br>Si: 4.4%<br>C: 0.8%<br>Ni: rem. | $Cr_3C_2$: 75%<br>Ni, Cr: 25%<br>Ni:Cr = 80:20 |
| 3 (Exp.) | (Mo, Cr)/$Mo_2C$ | NiCrFeBSiC: | |
| | $Mo_2C$: 35 v/o*<br>(Mo, Cr): rem.<br>Cr: 15%<br>C: 2%<br>Mo: rem. | Cr: 13.6%<br>Fe: 4.4%<br>B: 3.3%<br>Si: 4.4%<br>C: 0.8%<br>Ni: rem. | |
| 4 (Exp.) | (Mo, Cr)/$Mo_2C$ | Tribaloy T-800 | |
| | $Mo_2C$: 35 v/o*<br>(Mo, Cr): rem.<br>Cr: 15%<br>C: 2%<br>Mo: rem. | Cr: 17.1%<br>Fe: 1.1%<br>Mo: 28.7%<br>Si: 3.5%<br>Co: rem. | |
| 5 (Exp.) | (Mo, Cr)/$Mo_2C$ | Hastelloy C | |
| | $Mo_2C$: 35 v/o*<br>(Mo, Cr): rem.<br>Cr: 15%<br>C: 2%<br>Mo: rem. | Cr: 16.7%<br>Mo: 17.3%<br>Fe: 6.4%<br>Co: 0.3%<br>W: 4.6%<br>Mn: 0.7%<br>Ni: rem. | |

*calculated

TABLE II

| Sample | 1 | 2 | 3 | 4 | 5 |
|---|---|---|---|---|---|
| Comp. 1 | 80% | 65% | 80% | 75% | 75% |
| Comp. 2 | 20% | 25% | 20% | 25% | 25% |
| Comp. 3 | | 10% | | | |
| Grain sz. fr. | | | | | |
| +170 | | 1.4 | 0.1 | 0.1 | 0.1 |
| −170 | | | | | |
| +200 | | 11.1 | 3.2 | 2.6 | 2.7 |
| −200 | | | | | |
| +325 | | 40.7 | 69.3 | 49.5 | 50.8 |
| −325 | | 46.8 | 27.4 | 47.8 | 46.4 |
| HF, s/50 g | | 21 | 26 | 27 | 24 |
| BD, g/cm$^2$ | | 2.68 | 2.24 | 2.76 | 2.44 |

The coatings were analyzed for their phase structure using X-ray diffraction using Cu Kα radiation. The molybdenum lattice parameters were also determined from the diffraction data on 3 molybdenum peaks. This data was analyzed to determine the effects of carbon in the molybdenum lattices of the coatings. The interpretations of these data are listed in Table III below.

TABLE III

| Sample | Major Phase | Minor Phase | Other Phases | Lattice Par., Å |
|---|---|---|---|---|
| 1 | Mo | Ni-s.s.* | $MoO_2$ | 3.1479 |
| 2 | Mo-s.s. | Ni-s.s. | $Mo_2C$/MoC | 3.1436 |
| 3 | Mo-s.s. | Ni-s.s. | $Mo_2C$/MoC | 3.1411 |
| 4 | Mo-s.s. | Co-s.s. | $Mo_2C$/MoC | 3.1414 |
| 5 | Mo-s.s. | Ni-s.s. | $Mo_2C$/MoC | 3.1409 |

*s.s. = solid solution

The coatings from samples 1 and 3–5 were tested for mean superficial hardness and mean microhardness. The superficial hardnesses were measured using a Rockwell 15N Brale indentor, while the microhardness measurements were performed on coating cross sections using a diamond pyramid hardness tester at a load of 300 gf. (The term "gf" refers to gram force, a unit of force.) The data are presented in Table IV.

The superficial hardnesses of coatings 3–5 are all well within an acceptable range, with that of coating 3 being higher than that of the sample 1 coating and those of coatings 4 and 5 being close to that of coating 1. Further, the standard deviation of the superficial hardness of the new coatings are smaller than that of sample 1, indicating a coating of more uniform hardness.

The effect of the chromium and carbon in the (Mo,Cr) $Mo_2C$ used for the sample 3 coating versus the molybdenum used for the sample 1 coating is quite evident in that the coating of sample 3 exhibits increased hardness. Samples 1 and 3 have identical mixture ratios, as well as similar compositions including NiCrFeBSi pseudo alloy. The only difference is the presence of chromium in sample 3. Thus the improved hardness may be attributed to the presence of the (Mo,Cr)$Mo_2C$ solid solution alloy. (The variation in the standard deviation of the microhardness values is typical for such coatings and may be attributed to variations in local microstructure.)

The coatings from samples 4 and 5 are somewhat softer than that from sample 3, because the secondary Tribaloy and Hastelloy alloys are somewhat softer than the NiCrFeBSi alloy of sample 3, but still exhibit sufficient hardness for many applications. Further, the coatings of samples –5 are more corrosion resistant than that of sample 1, with the coatings of samples 4 and 5 being even more corrosion resistant than that of sample 3.

TABLE IV

| Sample | Superficial Hardness ($R_c$) | Microhardness ($DPH_{300}$) |
|---|---|---|
| 1 | 39 ± 3.8 | 459 ± 25 |
| 3 | 44 ± 1.6 | 527 ± 85 |
| 4 | 36 ± 1.5 | 342 ± 55 |
| 5 | 38 ± 3.0 | 391 ± 32 |

Friction and wear measurements were also conducted on the coatings of samples 1 and 3 using a ball-on-disk configuration and procedures established in the VAMAS program (H. Czichos et al., *Wear,* Vol. 114 (1987) pp. 109–130.). Kinetic friction coefficients and wear scars were measured on the unlubricated coatings using the ball-on-disk configuration and method illustrated and described in the above-referenced Sampath et al. publication (FIG. 1 and p. 284 of the publication). The results are shown below in Table V. (Lower values indicate superior friction and wear performance.)

TABLE V

| Sample | Load, N | Sliding Speed, m/s | Friction Coeff. | Wear Scar Width, mm |
|---|---|---|---|---|
| 1 | 10 | 0.02 | 0.86 ± 0.02 | 0.45 ± 0.04 |
| 3 | 10 | 0.02 | 0.73 ± 0.06 | 0.37 ± 0.03 |
| 1 | 40 | 0.05 | 0.63 ± 0.02 | 0.73 ± 0.04 |
| 3 | 40 | 0.05 | 0.66 ± 0.05 | 0.70 ± 0.01 |

A comparison of the two samples tested under the 10N load, the less severe load, illustrates the improvement in coating friction and wear characteristics provided by the (Mo,Cr)—C phase versus the Mo phase in the similar dual phase coatings. At 10N load and 0.02 m/s sliding speed, the sample 3 coating is clearly superior to the sample 1 coating. The 40N test conditions, however, were too severe for either coating to withstand. Thus the performance was nearly the same for the coatings of samples 1 and 3 at this load.

All of the above results show that the combination of molybdenum, chromium, and molybdenum carbide greatly improves the wear characteristics of molybdenum-based coatings over those of molybdenum alone. The blending of the molybdenum-based alloy including chromium and carbon with nickel- or cobalt-based alloys provides even further improvement in the coatings.

The invention described herein presents to the art novel, improved molybdenum-based composite powders and powder blends including such molybdenum-based composite powders suitable for use in applying corrosion resistant, high hardness, low-friction coatings to the bearing or friction surfaces of machine parts subject to sliding friction. The powder is suitable for a variety of applications in, e.g., the automotive, aerospace, pulp and paper, and plastic processing industries. The coatings provide low friction surfaces and excellent resistance to scuffing and delamination under sliding contact conditions, improved high temperature strength and oxidation and corrosion resistance. The powders may be tailored to provide coatings exhibiting optimal properties for various applications by proper selection of components and proportions. All of the powders of the compositions given above improve the mechanical and chemical properties of molybdenum coatings without sacrificing molybdenum's unique low-friction characteristics or the sprayability of the powders.

While there have been shown and described what are at present considered the preferred embodiments of the invention, it will be apparent to those skilled in the art that modifications and changes can be made therein without departing from the scope of the present invention as defined by the appended claims.

We claim:

1. A molybdenum-based composite powder for thermal spray applications, said composite powder comprising an alloy selected from the group consisting of molybdenum-chromium, molybdenum-tungsten, and molybdenum-tungsten-chromium alloys dispersion strengthened with molybdenum carbide precipitates.

2. A molybdenum-based composite powder in accordance with claim 1 wherein said composite powder comprises about 10–30 weight percent of at least one metal selected from the group consisting of chromium and tungsten, about 1–3 weight percent carbon, remainder molybdenum.

3. A molybdenum-based composite powder in accordance with claim 2 wherein said composite powder consists essentially of about 10–30 weight percent chromium, about 1–3 weight percent carbon, remainder molybdenum.

4. A molybdenum-based composite powder in accordance with claim 2 wherein said composite powder consists essentially of about 10–30 weight percent tungsten, about 1–3 weight percent carbon, remainder molybdenum.

5. A blended powder for thermal spray, applications, said blended powder comprising a mixture of (a) a molybdenum-based alloy selected from the group consisting of molybdenum-chromium, molybdenum-tungsten, and molybdenum-tungsten-chromium alloys dispersion strengthened with molybdenum carbide precipitates, and (b) a nickel-based or cobalt-based alloy.

6. A blended powder in accordance with claim 5 consisting essentially of about 10–50 weight percent of said nickel-based or cobalt-based alloy, the remainder being said dispersion strengthened molybdenum-based alloy.

7. A blended powder in accordance with claim 6 wherein said dispersion strengthened molybdenum-based alloy comprises about 10–30 weight percent of at least one metal selected from the group consisting of chromium and tungsten, about 1–3 weight percent carbon, remainder molybdenum.

8. A blended powder in accordance with claim 7 wherein said nickel-based or cobalt-based alloy is a self-fluxing nickel-based alloy comprising nickel, chromium, iron, boron, and silicon.

9. A blended powder in accordance with claim 8 wherein said nickel-based alloy consists essentially of, in percent by weight, 0 to about 20% chromium, 0 to about 4% iron, about 2–5% boron, about 2–5% silicon, 0 to about 2% carbon, remainder nickel.

10. A thermal spray coating comprising lamellae of a molybdenum-based alloy selected from the group consisting of molybdenum-chromium, molybdenum-tungsten, and molybdenum-tungsten-chromium alloys dispersion strengthened with molybdenum carbide precipitates.

11. A coating in accordance with claim 10 wherein said molybdenum-based alloy comprises about 10–30 weight percent of at least one metal selected from the group consisting of chromium and tungsten, about 1–3 weight percent carbon, remainder molybdenum.

12. A coating in accordance with claim 10 further comprising lamellae of a nickel-based or cobalt-based alloy.

13. A coating in accordance with claim 12 consisting essentially of about 10–50 weight percent of said nickel-based or cobalt-based alloy, the remainder being said dispersion strengthened molybdenum-based alloy.

14. A coating in accordance with claim 13 wherein said dispersion strengthened molybdenum-based alloy comprises about 10–30 weight percent of at least one metal selected from the group consisting of chromium and tungsten, about 1–3 weight percent carbon, remainder molybdenum.

15. A coating in accordance with claim 11 wherein said nickel-based or cobalt-based alloy is a self-fluxing nickel-based alloy comprising nickel, chromium, iron, boron, and silicon.

* * * * *